US005679103A

United States Patent [19]

Pratchett

[11] Patent Number: 5,679,103

[45] Date of Patent: Oct. 21, 1997

[54] EXERCISING DEVICE

[76] Inventor: Vincent Pratchett, 35 Castlefield Ave., Toronto, Ontario, Canada, M4R 1G5

[21] Appl. No.: 607,006

[22] Filed: Feb. 26, 1996

[51] Int. Cl.[6] ..... A63B 21/00

[52] U.S. Cl. ..... 482/83; 482/87

[58] Field of Search ..... 273/58 C, 26 R; 482/29 A, 83–90; 473/440–445

[56] References Cited

U.S. PATENT DOCUMENTS

| | | | |
|---|---|---|---|
| 4,077,624 | 3/1978 | Feaser | 482/87 |
| 4,434,980 | 3/1984 | Babineaux | 482/89 |
| 4,564,192 | 1/1986 | Lebowitz | 482/87 |
| 5,389,057 | 2/1995 | Zagata, Jr. | 482/87 |
| 5,435,545 | 7/1995 | Marotta | 275/26 R |
| 5,554,088 | 9/1996 | Zlojutso | 482/87 |

OTHER PUBLICATIONS

Inside Kung–Fu Magazine, selected advertsiments, Feb./1996, U.S.A.

Black Belt Magazine, selected advertisiments, Feb./1996, U.S.A.

*Primary Examiner*—Jerome Donnelly

*Attorney, Agent, or Firm*—Merek & Voorhees

[57] ABSTRACT

An exercising device of the type that may be used in hand to hand combat training or to enhance hand, eye and foot reflexes and coordination is disclosed. The device comprises a central longitudinal body which is generally vertically oriented and has at least one elongate cross member, having two opposing ends, pivotally mounted on the central body. The said opposing ends extend radially outward in opposite directions from said central body allowing the cross member to rotate about the longitudinal axis of the central body. When one of said ends of the cross member is struck by the hand or foot of an operator the end moves rotationally away from said operator while the opposing end moves rotationally toward the operator thereby requiring the operator to react defensively to avoid being hit by the opposing end.

8 Claims, 3 Drawing Sheets

EXERCISING DEVICE

FIELD OF THE INVENTION

This invention relates to exercise devices of the type that may be used to enhance hand to hand combat training techniques and to improve hand, eye and foot reflexes and coordination.

BACKGROUND OF THE INVENTION

For centuries people have trained and studied hand to hand combat techniques as a means of self defense and also as a means of maintaining physical fitness. People today engage in a large number of sports which combine combat techniques and fitness. In general these sports can be categorized as the martial arts and boxing sports. In each instance the actively involves the use of the hands and/or feet.

In order to excel in the martial arts, or in boxing, participants must continually practice so as to learn and master various hand and foot movements, and also to develop and enhance hand, eye and foot coordination and reflexes. To this extent a large number of training techniques and devices have been developed over time. These devices and techniques usually involve some form or type of sparring with either another participant or with a sparring dummy. For individual training, participants have generally been limited to practicing hand and foot movements through the use of suspended bags most often referred to as speed bags and heavy bags, speed bags; generally being smaller tear drop shaped suspended air filled bags used to develop hand/eye coordination and heavy bags usually comprising larger suspended padded bags used to develop punching power and kicking technique. For particular use in the martial arts field, stationary dummies have been developed. These dummies typically comprise a central post and a fixed horizontal cross member that relates generally to the size and shape of a person having arms outstretched.

While prior training and exercising devices offer a variety of methods to enhance exercising techniques related to the martial arts and boxing, they suffer from a common and inherent drawback in that they are generally static devices. Such devices are somewhat helpful for offensive training but offer little, if any, assistance in defensive training. The nature of these prior art devices severely limits their application and usefulness making it necessary to spar against other individuals in order to effectively enhance both offensive and defensive skills. While there may be advantages associated with sparring against another individual, for purposes of routine training individual sparring limits the time and place when training can take place and increases the risk of injury to one of the participants.

SUMMARY OF THE INVENTION

Accordingly, the present invention in one of its aspects provides an exercising device of the type that may be used in hand to hand combat training or to enhance hand, eye and foot reflexes and coordination, the device comprising: a central longitudinal body generally vertically oriented; and, at least one elongate cross member, having two opposing ends, pivotally mounted on said central body with said ends of said elongate cross member extending radially outward in opposite directions from said central body, said cross member rotatable about the longitudinal axis of said central body such that when one of said ends of cross member is struck by the hand or foot of an operator said end moves rotationally away from said operator while said opposing end of said cross member moves rotationally toward said operator thereby requiring said operator to react defensively to avoid being hit by said opposing end of said cross member.

In a further aspect the device has an upper and a lower elongate cross member, said upper elongate cross member pivotally mounted generally perpendicular to said central body, said lower elongate cross member pivotally mounted on said central body such that said lower elongate cross member and said central body form an acute angle therebetween.

The objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
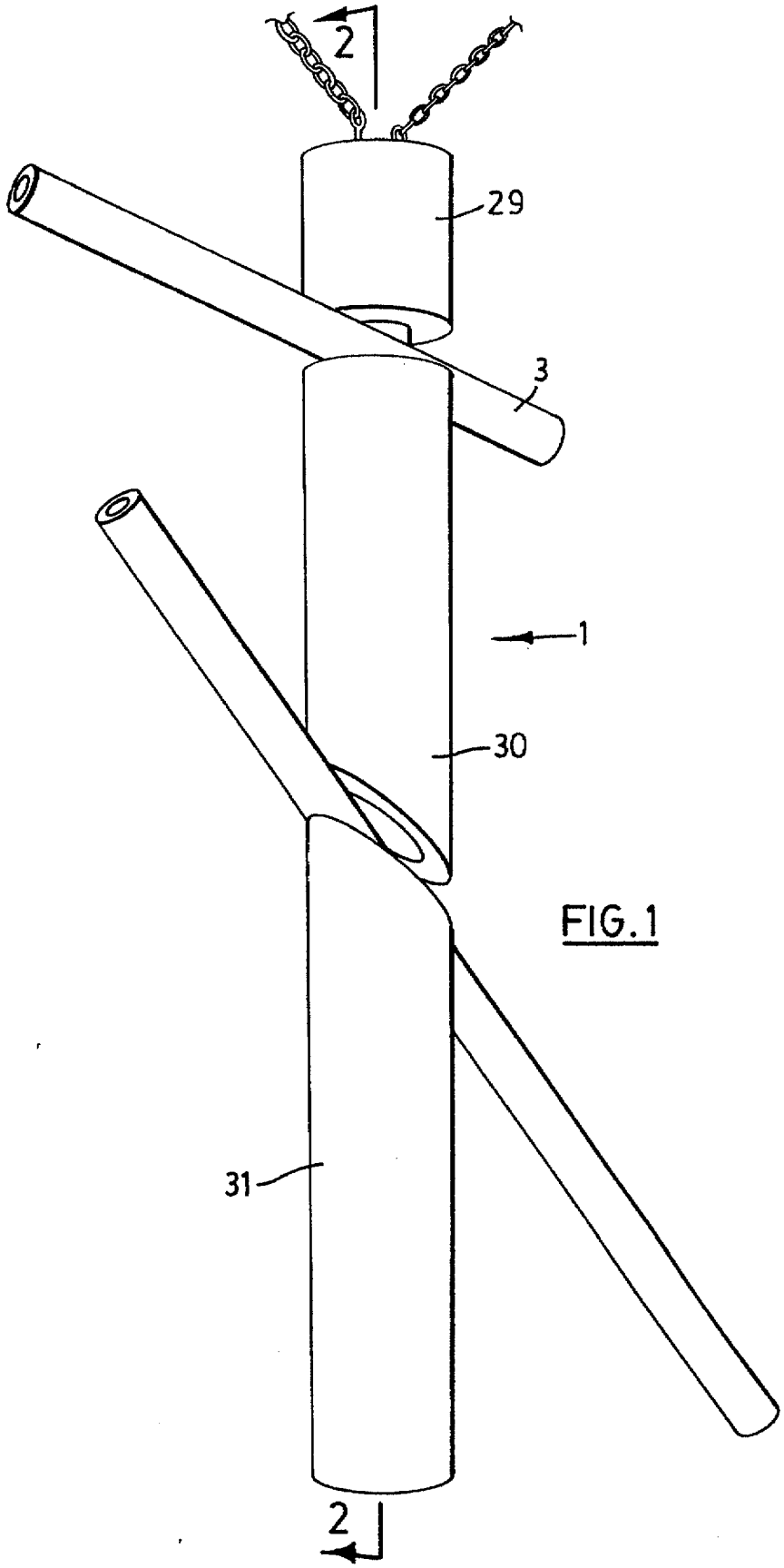
FIG. 1 is a side perspective view of the device according to the present invention.

The exercise device according to the present invention is shown in perspective view in FIG. 1 and noted generally by the reference numeral 1. Exercise device 1 is comprised generally of a central longitudinal body 2, which is generally vertically oriented, and at least 1 elongate cross member 3. In the preferred embodiment exercise device 1 includes two cross members, shown in FIG. 1 as upper cross member 4 and lower cross member 5.

Figure 2:
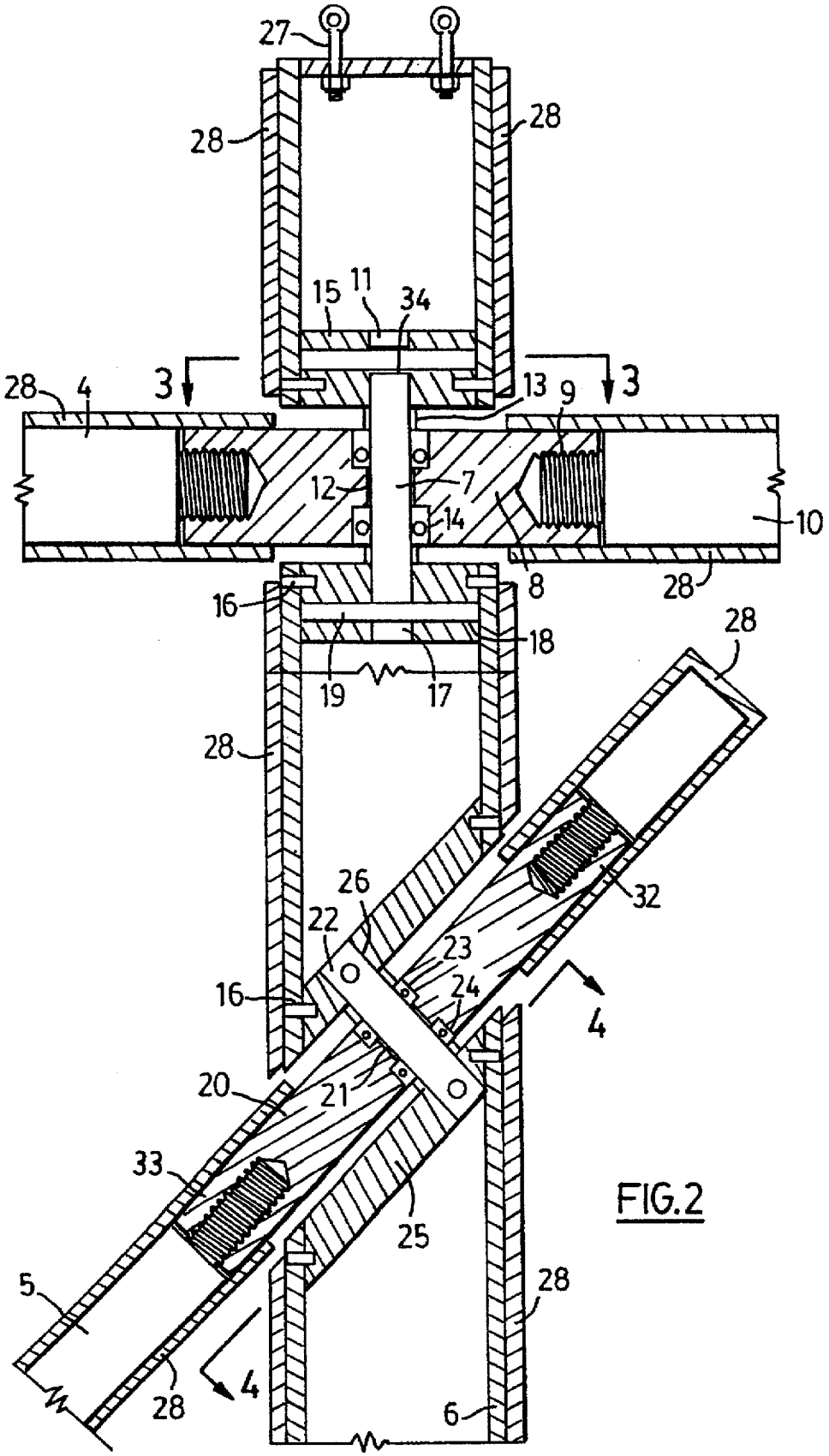
FIG. 2 is a sectional view taken along the line 2—2 of FIG. 1.

Referring now to FIG. 2, central body 2 is preferably comprised of a hollow pipe-like structure 6 that would typically have a diameter of approximately 3 to 5 inches. Hollow pipe structure 6 would also typically be in 3 separate sections joined together by pivotal mounting means 7 that serve to hold the 3 sections of the hollow pipe structure 6 together to form central body 2, and which also serve to pivotally mount upper and lower cross members 4 and 5 onto central body 2.

Aside from their lengths and their orientation with respect to central body 2, upper and lower cross members 4 and 5 are essentially identical in structure. They are also pivotally mounted onto central body 2 in essentially the same fashion. By way of example the structure of upper cross member 4 will now be discussed. As shown in FIG. 2 upper cross member 4 includes a rigid support member 8 that is preferably comprised of a strong solid material such as aluminum, steel or a high strength plastic or fibreglass. Preferably rigid support member 8 is generally cylindrical in shape with a threaded bore 9 on each end for receiving a correspondingly threaded extension member 10. In the preferred embodiment, extension number 10 is comprised of a wooden dowel or rod but could equally be a plastic rod having a lower specific gravity than rigid support member 8, and hence a lesser weight to length ratio. It will be appreciated by those skilled in the art that while in the preferred embodiment extension number 10 is threaded into rigid support member 8, numerous other means of fastening the particular structures together could be used, including the use of bolts, pins, adhesive or by way of a friction fit. It will also be appreciated that the use of rigid support member 8 will provide a means to pivotally mount upper cross member 4 onto central body 2 thereby providing sufficient strength and integrity to withstand the forces to which it will be subjected during use.

Through the incorporation of a pair of extension members 10 which extending radially outward from the ends of rigid support member 8, the overall weight of upper cross member 4 may be reduced from what it would otherwise have been if the entire upper cross member 4 was comprised of the same material as rigid support member 8. This has the advantage of reducing the inertial force required to be overcome in order to pivot upper cross member 4 about central body 2. Conversely, this also reduces the amount of force needed to stop the movement of upper cross member 4 when it is rotating about central body 2. Furthermore, the ability to readily remove extension numbers 10 enables exercise device 1 to be broken down into smaller component parts for purposes of shipping and storing. Finally, extension members 10 can be easily interchanged to increase or decrease their length, or for replacement should they become broken or damaged.

Once again using upper cross member 4 for purposes of illustration while bearing in mind that lower cross member 5 in essence operates in the same fashion, central body 2 includes a upper shaft 11 which, in the preferred embodiment, is aligned parallel to the longitudinal axis of central body 2. Rigid support member 8 contains a bore 12 which is generally perpendicular to its longitudinal axis and through which upper shaft 11 is received. In this manner upper shaft 11 will secure upper cross member 4 to central body 2 and will provide a pivot axis about which upper cross member 4 can rotate.

Bore 12 is slightly larger in diameter than upper shaft 11 such that upper cross member 4 is free to rotate about shaft 11, and hence central body 2. However, the dimensional tolerances between bore 12 and shaft 11 are also significantly small enough to prevent wobbling of cross member 4 as it rotates. A pair of upper bushings 13, positioned with one bushing on each side of rigid support member 8, encompass upper shaft 11 where it exists bore 12. Bushings 13 assist in preventing rigid support member 8 from sliding upwardly or downwardly along shaft 11. To reduce the frictional contact between shaft 11 and bore 12 upper bearing means 14 are located between shaft 11 and bore 12.

In order to securely hold upper shaft 11 in central body 2, a pair of end blocks 15 are utilized. Since in the preferred embodiment central body 2 is in the form of a hollow pipe, end blocks 15 will preferably take the form of disk shaped structures that may be received into the open ends of the individual portions of central body 2 (as is more clearly shown in FIG. 2). That is, the diameter of end blocks 15 corresponds approximately to the internal diameter of the hollow pipe structure forming central body 2 such that blocks 15 may be received therein. A series of set screws 16 are then used to securely hold end blocks 15 within central body 2. It will be appreciated that various other methods for mechanically holding end blocks 15 within central body 2 (including bolts, pins and threaded engagements) may equally be employed.

End blocks 15 are equipped with bores 17 which extend through them, generally parallel to their minor axes, in order to accommodate the ends of upper shaft 1 I. As shown in FIG. 2 end blocks 15 also contain a further bore 18 that is perpendicular to bore 17. When the ends of shaft 11 are received within bores 17 of end blocks 15, a bore 34 that passes through the ends of shaft 11 may be aligned with bore 18 such that a pair of pins 19 can be inserted through bores 18 and 34 to securely hold both ends of upper shaft 11 within the respective end blocks 15. Once again it will be understood by those skilled in the art that this particular method of securing shaft 11 within end blocks 15 is beneficial from the perspective of simplicity and also from the view of preventing rotation of shaft 11 about its longitudinal axis as cross member 4 rotates about central body 2. However, other methods of mechanically holding shaft 11 in place could equally be utilized. For example, the ends of shaft 11 could extend beyond end blocks 15, and could be held in place by way of a threaded nut.

As discussed above, the pivotal mounting of lower cross member 5 on central body 2 is in essence both structurally and functionally the same as the pivotal mounting discussed and described above for upper cross member 4. The primary difference is the angle of orientation of lower cross member 5. In the preferred embodiment lower cross member 5 is pivotally mounted on central body 2 such that it forms an acute angle with central body 2, whereas in the preferred embodiment upper cross member 4 is generally perpendicular to central body 2.

Again referring to FIG. 2, to pivotally mount lower cross member 5 on central body 2 a lower rigid support member 20, having a bore 21 therethrough, is utilized in association with a lower shaft 22 in the same fashion as rigid support member 8 is mounted on upper shaft 11. Similarly a set of lower bearing means 23, lower bushings 24 and lower end blocks 25 are utilized. Once again the only main difference in the structure from that as described with respect to upper cross member 4 is the 45 degree angle of inclination.

Figure 3:
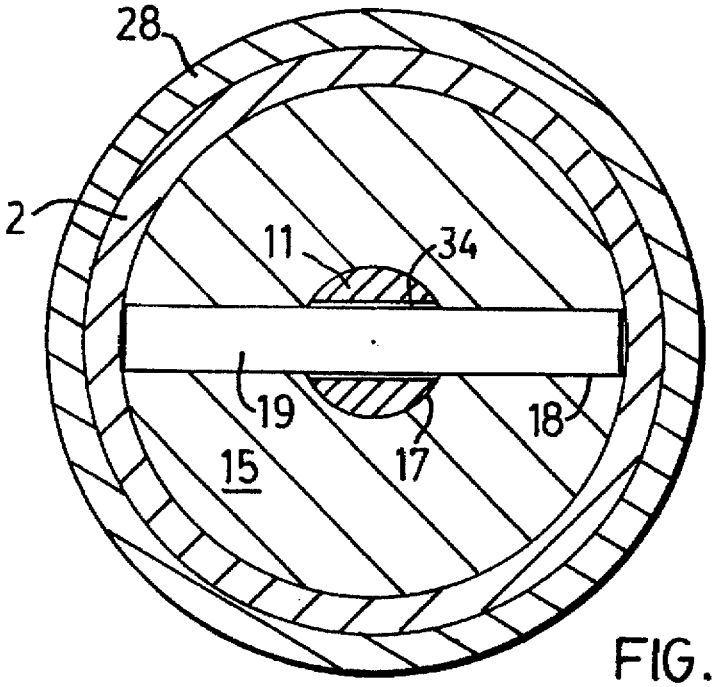
FIG. 3 is a sectional view taken along the line 3—3 of FIG. 2.
Figure 4:
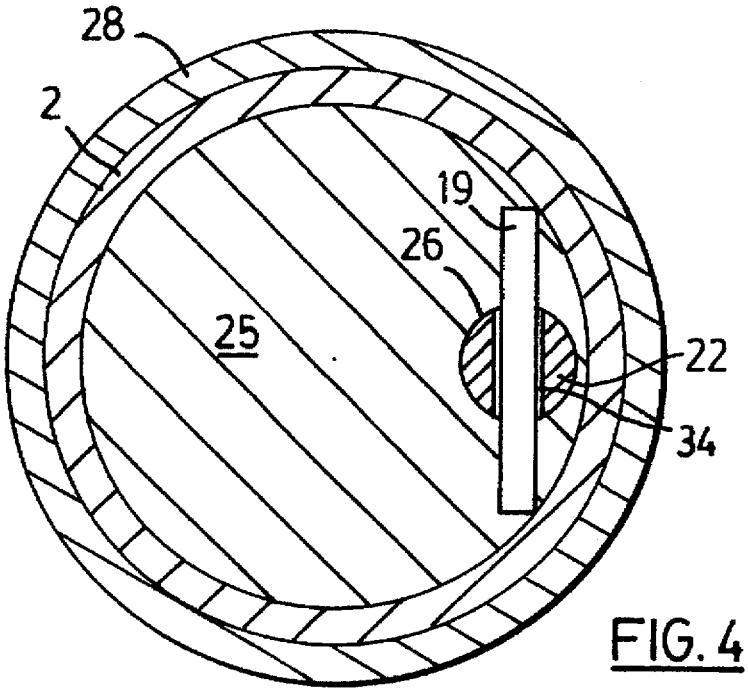
FIG. 4 is a sectional view taken along the line 4—4 of FIG. 2.

Lower shaft 22 is held within lower end blocks 25 using the same bore and pin structure as described with respect to upper cross member 4 with one minor exception. As shown in FIG. 2, since lower shaft 22 is inclined at an angle of approximately 45 degrees to the longitudinal axis of central body 2, bores 26, that extend through lower end blocks 25 to receive the ends of lower shaft 22, are offset from the central portion of end blocks 25. The offset nature of bore 26, as opposed to the central positioning of bore 17, is more clearly shown in FIGS. 3 and 4.

To assist in the operation of exercise device 1, suspension means 27 are attached to the upper end of central body 2 so that the device can be hung from the roof or ceiling of a gymnasium or training facility. Suspension means 27 would typically comprise a pair of eye bolts or similar type structures. In order to reduce the potential for injury when using device 1 the exposed surfaces of central body 2 and upper and lower cross members 4 and 5 are covered with a padding material 28 comprised of foam or a similar type substance.

It will be appreciated that in accordance with the structure as described above, exercise device 1 may be easily assembled and disassembled for purposes of maintenance, storage and shipping. As indicated, central body 2 is comprised essentially of 3 separate portions, 29, 30 and 31, which are held together in a vertical orientation through the use of upper and lower shafts 11 and 22 in combination with upper and lower end blocks 15 and 25. Set screws 16 enable the entire assembly to be quickly taken apart or put together. Furthermore, and also as discussed previously, the ability to easily remove extension members 10 from upper rigid support member 8 and lower rigid support member 20 add further to the flexibility of the use, storage and transportation of the device.

In the preferred embodiment shown in FIG. 1, upper cross member 4 is positioned symmetrically around the longitudinal axis of central body 2. This is accomplished by locating bore 12 at the approximate mid-point along the longitudinal axis of cross member 4. That is, when assembled the distance from upper shaft 11 to the opposite ends of upper cross member 4 is approximately equal. On the contrary, lower cross member 5 is not symmetrically positioned about lower shaft 22. Through positioning bore 20 along the longitudinal axis of lower cross member 5 at a distance from the mid-point of lower cross member 5, a non-symmetrical structure is formed. In the preferred embodiment this is accomplished by inserting a somewhat shorter extension member 10 into the upper end 32 of lower rigid support member 20 and inserting a somewhat longer extension member 10 into the lower end 33 of lower rigid support member 20. In this fashion the distance from lower shaft 22 to the opposite ends of lower cross member 5 is not identical. One end of lower cross member 5 will therefore extend radially outward from central body 2 to a greater degree than the opposite end.

In operation device 1 is typically hung in a generally vertical orientation from the ceiling of a gymnasium or training facility. Upper cross member 4 would then be in a generally horizontal configuration, be pivotally mounted on the central body, and have its ends extending radially outward in opposite directions. Lower cross member 5 is preferably spaced vertically beneath upper cross member 4 along the longitudinal axis of central body 2 and forms an angel of approximately 45 degrees therewith. When one of the ends of upper cross member 4 is struck by the hand or foot of an operator that end will move rotationally away from the operator while the opposite end of upper cross member 4 will move rotationally toward the operator.

If central body 2 is vertically oriented and upper cross member 4 is perpendicular to central body 2, the rotation of upper cross member 4 will be in a generally horizontal plane. In this manner central body 2 will generally resemble the body of an individual with upper cross member 4 resembling shoulders and arms. Accordingly, when engaged in hand to hand combat training, as an operator strikes one end of upper cross member 4 the other end will move rotationally toward the operator thereby requiring the operator to react defensively to avoid being hit by the opposing end. This dynamic nature of device 1 enables it to more realistically simulate actual combat situations by reacting to an offensive strike by the operator. In addition, as upper cross member 4 can be rotated in either direction it can be equally used in either a right hand or left hand training exercise.

The movement of lower cross member 5 during operation is in essence very similar to upper cross member 4. The substantial difference between the movement of lower cross member 5 and upper cross member 4 relates to the fact that lower cross member 5 is at an approximate 45 degree angle to central body 2 and that its ends do not extend outwardly from central body 2 to the same degree. The particular structure of lower cross member 5 is meant to represent (at its bottom end) the leg of an individual. The upper end of lower cross member 5 is meant to represent the stomach or abdomen, hence the combination of central body 2 and upper and lower cross members 4 and 5 present the overall representation of a sparring dummy.

When sparring or exercising with device 1, punching or kicking the upper end of lower cross member 5 will force the lower end of cross member 5 to rotate toward the operator in a fashion similar to the way in which a live sparring partner would deliver a kick. When delivering a "head kick", the foot of a live sparring partner generally travels in a plane inclined at approximately 45 degrees. For this reason in the preferred embodiment lower cross member is inclined at an angle of approximately 45 degrees thereby helping to simulate live movement. The lower end of lower cross member 5 will move in an inclined plane from a position generally level with the bottom of central body 2 upwardly to a position above the pivotal point of lower cross member 5. This type of movement has proven to be extremely useful for defensive training in hand to hand combat techniques to force an individual to be prepared to block a kick after striking a blow to the abdomen of an opponent. In a similar way, kicking the lower end of lower cross member 5 will force it to rotate in a reverse direction such that it will swing back away from the operator, around the pivot point of lower cross member 5, and then back toward the operator thereby simulating a punching motion from an opponent in retaliation to a lower body kick. During use of device 1 the combination of the types of movements of cross members 4 and 5 as discussed will enable an operator to improve both offensive and defensive combat techniques as well as improve hand, eye and foot coordination and reflexes.

It will be appreciated that what has been described herein represents the preferred embodiments of the present invention but that alternations and variations to those embodiments could be made while still remaining within the scope of the invention. For example, while upper and lower cross members 4 and 5 have been described as being comprised of a rigid support member and a pair of extension numbers, they could equally be a single member of unitary construction. Furthermore, while central body 2 has been described as being formed of a hollow pipe structure, it could equally be solid or of a configuration other than that of a pipe.

I claim:

1. An exercising device of the type that may be used in hand to hand combat training or to enhance hand, eye and foot reflexes and coordination, the device comprising:

a central longitudinal body generally vertically oriented; and, an upper and a lower cross member, each of said cross members having two opposing ends, said cross members pivotally mounted on said central body with said opposing ends extending radially outward in opposite directions from said central body, said cross members rotatable about the longitudinal axis of said central body such that when one of said ends of said upper or lower cross members is struck by the hand or foot of an operator said end moves rotationally away from said operator while said opposing end of said cross member moves rotationally toward said operator thereby requiring said operator to react defensively to avoid being hit by said opposing end of said cross member, said central body including an upper and a lower shaft and each of said upper and said lower cross members including a bore extending therethrough, said bores being generally perpendicular to the longitudinal axes of said respective cross members, said upper and lower shafts of said central body being received within said bores of said upper and lower cross members, respectively, thereby permitting said cross members to rotate about said respective shafts and hence said central body.

2. A device as claimed in claim 1 wherein said lower elongate cross member is pivotally mounted on said central body such that said lower elongate cross member and said central body form an acute angle therebetween.

3. A device as claimed in claim 2 including bearing means located between said respective bores and shafts to reduce frictional contact therebetween.

4. A device as claimed in claim 3 wherein said bore through said upper cross member is positioned at the approximate mid-point along the longitudinal axis of said cross member.

5. A device as claimed in claim 4 wherein said bore through said lower cross member is positioned along the longitudinal axis of said lower cross member at a distance from the mid-point of said longitudinal axis such that one end of said lower cross member extends radially outward from said central body to a greater degree than the opposite end of said lower cross member.

6. A device as claimed in claim 5 wherein said angle between said lower cross member and said central body is approximately 45 degrees.

7. A device as claimed in claim 6 wherein the exposed surfaces of said central body and said cross members are padded.

8. A device as claimed in claim 7 including suspension means to hang said central body from the roof or ceiling of a gymnasium or a training facility.

* * * * *